US006092711A

United States Patent [19]

Tinarelli

[11] Patent Number: 6,092,711

[45] Date of Patent: Jul. 25, 2000

[54] MAGAZINE FOR COMPRESSED-AIR NAIL FIRING TOOL

[75] Inventor: Danilo Tinarelli, Pieve Di Cento, Italy

[73] Assignee: Temar S.r.l., S. Pietro in Casale, Italy

[21] Appl. No.: 09/257,478

[22] Filed: Feb. 25, 1999

[30] Foreign Application Priority Data

Feb. 27, 1998 [IT] Italy ..... BO980023 U

[51] Int. Cl.[7] ..... B25C 5/16

[52] U.S. Cl. ..... 227/109; 227/120; 227/136

[58] Field of Search ..... 227/109, 119, 227/120, 135, 136

[56] References Cited

U.S. PATENT DOCUMENTS 3,834,602 9/1974 Obergfell ..... 227/120
4,558,811 12/1985 Klaus ..... 227/120
5,368,213 11/1994 Massari, Jr. ..... 227/120
5,813,588 9/1998 Lin ..... 227/109
5,873,509 2/1999 Liao ..... 227/109

*Primary Examiner*—Scott A. Smith
*Attorney, Agent, or Firm*—Guido Modiano; Albert Josif; Daniel O'Byrne

[57] ABSTRACT

A magazine for a compressed-air nail firing tool, comprising a fastener guiding channel which is delimited laterally by a pair of flat and parallel walls, wherein one of the walls is fixed to the body of the firing tool, while the other wall is constituted by an access flap which is hinged to the fixed wall about a longitudinal axis, so as to allow lateral opening of the fastener guiding channel over at least a significant part of its length, elements being further provided for retaining the access flap in the position for closing the fastener guiding channel.

5 Claims, 5 Drawing Sheets

MAGAZINE FOR COMPRESSED-AIR NAIL FIRING TOOL

BACKGROUND OF THE INVENTION

The present invention relates to a magazine for a compressed-air nail firing tool.

Compressed-air nail firing tools, generally called nailers, are constituted by a body comprising a cylindrical head, in which the hammer body slides, and a handle which protrudes from said head. A firing channel is aligned in a downward region with the cylindrical head, and a nail guiding channel, belonging to a magazine, enters said firing channel. The nails to be fired are made to advance in the guiding channel by a pusher and are individually positioned in the firing channel, from which they are ejected by the hammer body by way of a stem which can slide in said channel and acts axially on the nails. The nails to be inserted in the magazine are joined in packs by interposing a suitable adhesive.

Fastening elements of shapes suitable to be fired by a firing tool, which will be called hereinafter, generically, fasteners have different lengths according to requirements, and for each length the guiding channel must have dimensions which are suitable to support the fasteners during their advancement. Solutions have been proposed which use magazines in which the guiding channel has a plurality of longitudinal slots which are arranged at different levels and are adapted to guide the fasteners to be used.

The presence of said plurality of slots determines a certain play in the fastener guiding channel; accordingly, especially when the pack of fasteners is constituted by a plurality of separate units, the pressure applied by the pusher often causes the overlap of two or more units inside the guiding channel, consequently jamming the tool.

The procedure for removing packs that have overlapped in this manner is rather complicated in view of the difficulties in accessing the guiding channel when one wishes to free it from fasteners that have remained jammed inside it.

SUMMARY OF THE INVENTION

The aim of the present invention is to solve the above-cited drawbacks of conventional devices, i.e., to provide a device which allows quicker and less awkward access to the guiding channel and the same time prevents as much as possible any overlap of the packs of nails.

Within the scope of this aim, an object of the present invention is to provide a structure which is simple, relatively easy to provide in practice, safe in use, effective in operation and relatively low in cost.

This aim and this object are all achieved by the present magazine for a compressed-air nail firing tool, which comprises a fastener guiding channel delimited laterally by a pair of flat and parallel walls, characterized in that one of said walls is fixed to the body of the firing tool, while the other wall is constituted by an access flap which is hinged to the fixed wall about a longitudinal axis, so as to allow lateral opening of the fastener guiding channel over at least a significant part of its length, means being further provided for retaining the access flap in the position for closing the fastener guiding channel.

BRIEF DESCRIPTION OF THE DRAWINGS

Further characteristics and advantages of the present invention will become particularly evident and clear from the following detailed description of a preferred but not exclusive embodiment of a magazine for a compressed-air nail firing tool according to the invention, illustrated only by way of non-limitative example in the accompanying drawings, wherein.

DESCRIPTION OF THE PREFERRED EMBODIMENTS

Figure 1:
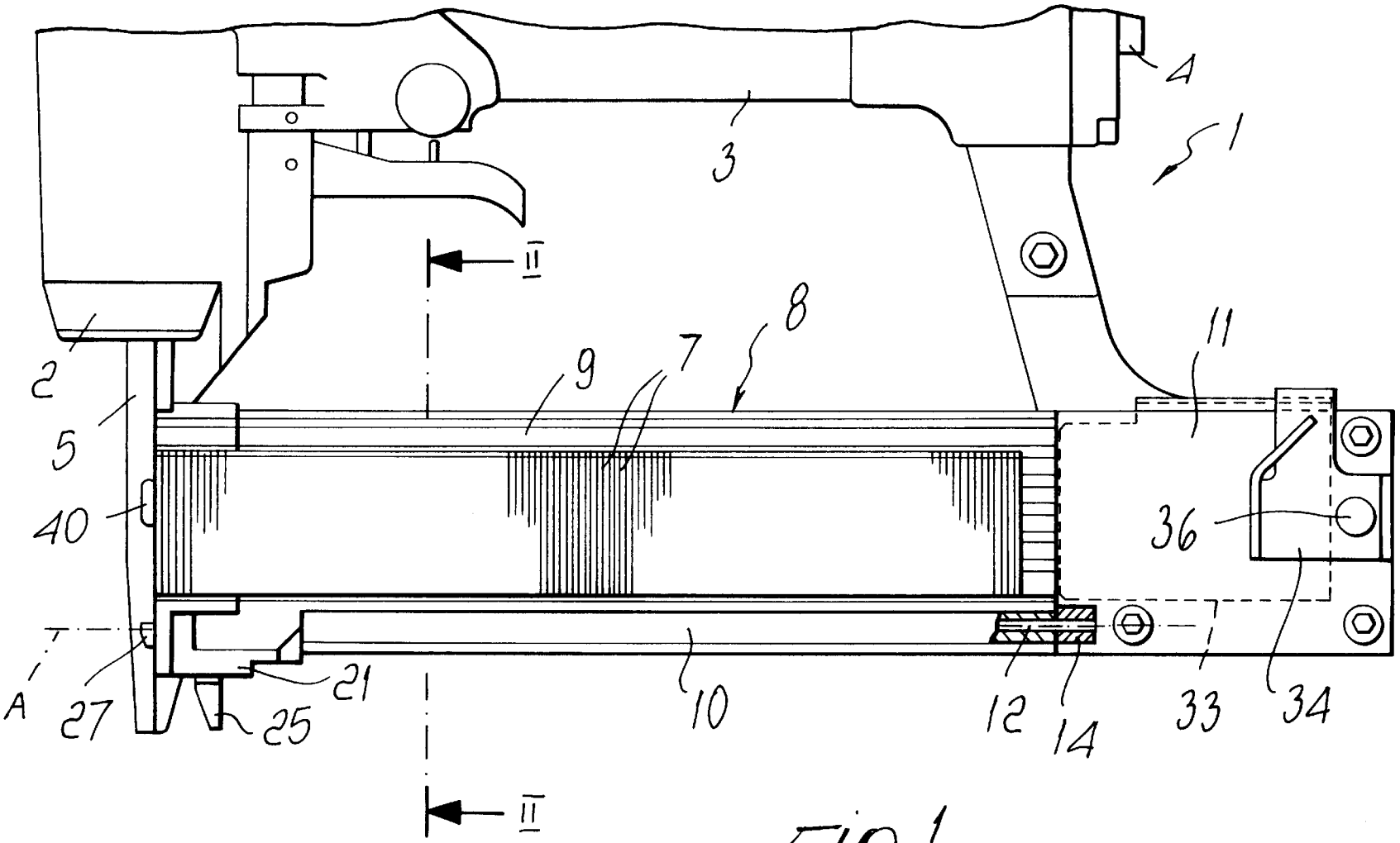
FIG. 1 is a side view of a nail firing tool provided with a magazine according to the present invention, with the access flap open and arranged at right angles to the plane of the drawing.
Figure 2:
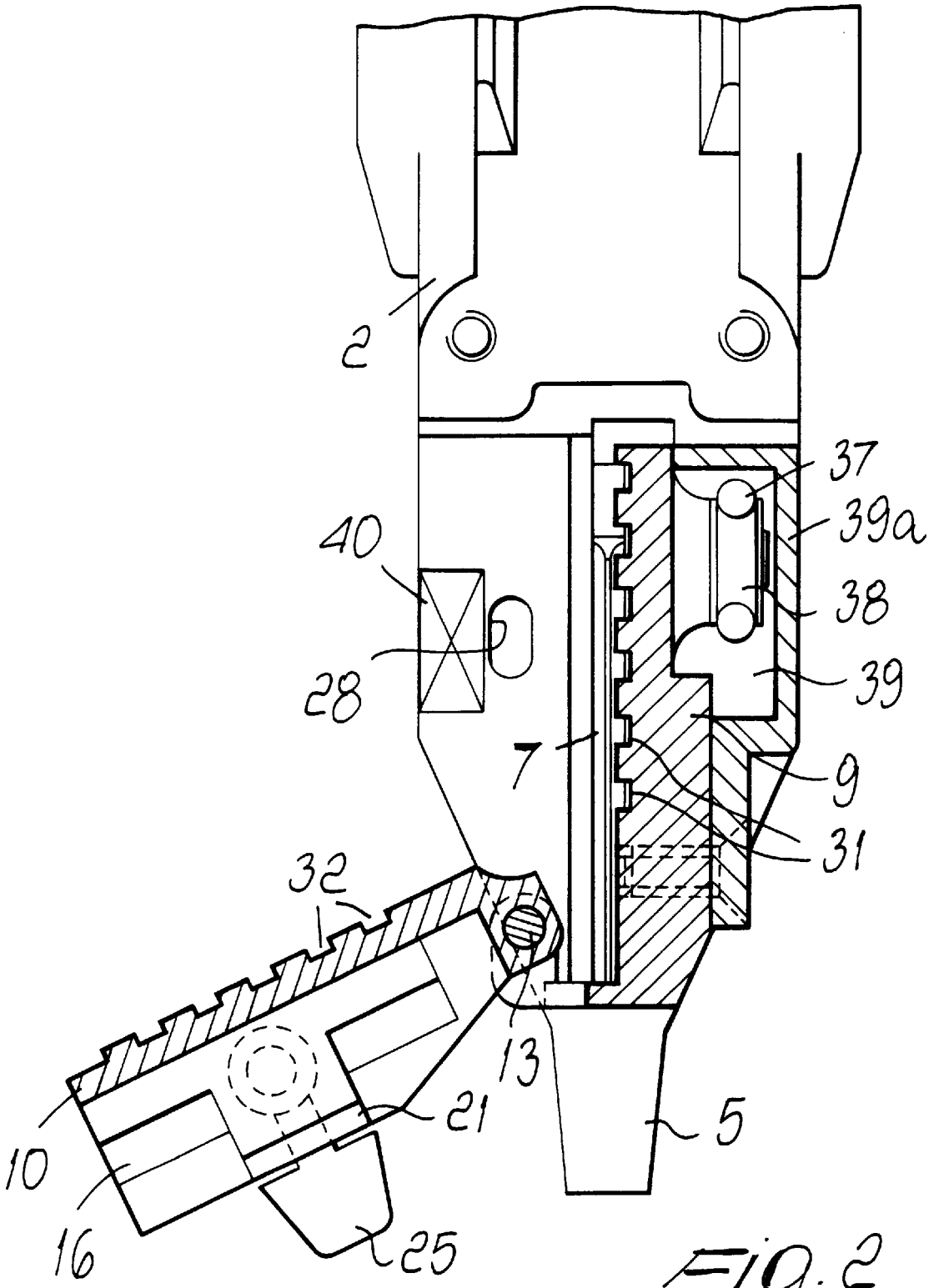
FIG. 2 is a sectional view, taken along the plane II—II of FIG. 1.
Figure 3:
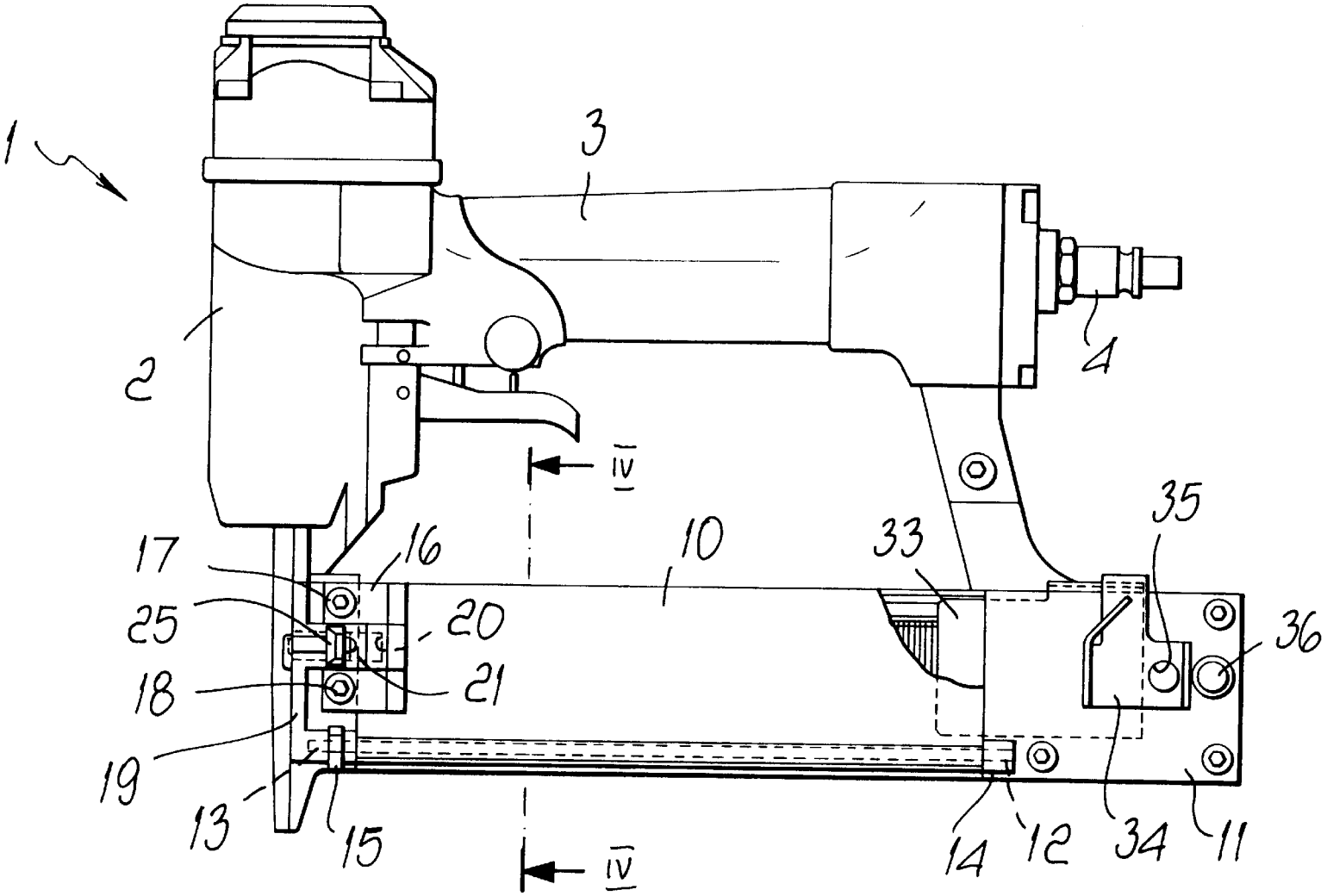
FIG. 3 is a side view of the nail firing tool with the access flap closed.
Figure 4:
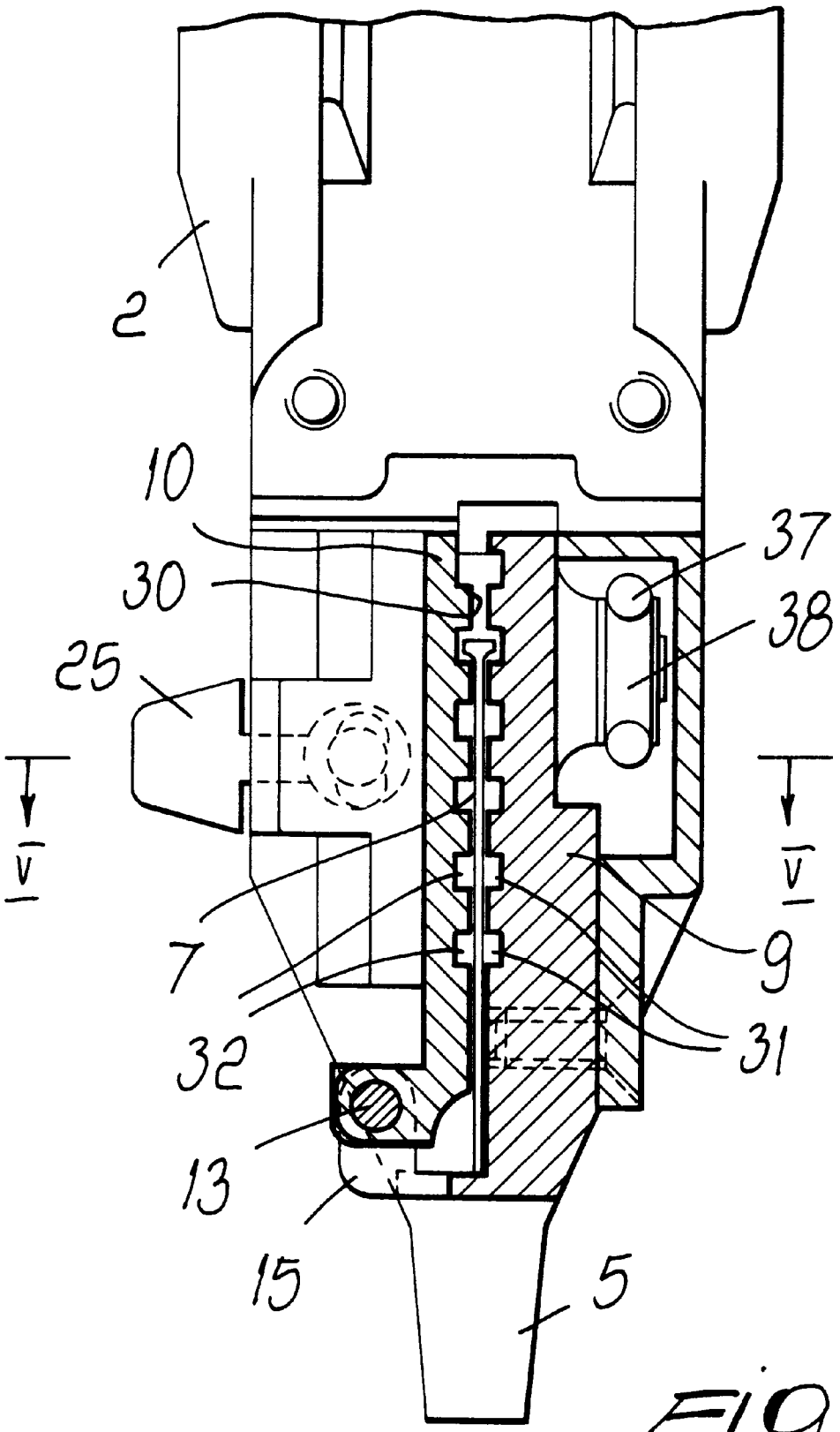
FIG. 4 is a sectional view, taken along the plane IV—IV of FIG. 3.

With particular reference to the above Figures, the reference numeral 1 generally designates the body of the compressed-air nail firing tool, comprising a cylindrical head 2 whereto a handle 3 is rigidly coupled; said handle has, at its end, a coupling sleeve 4 for connection to a source of compressed air. A firing tube 5 protrudes from the head 2 and is axially crossed by a channel 6 for firing the nails 7.

The fasteners 7 form packs which are contained in a magazine which is generally designated by the reference numeral 8. The magazine 8 comprises a box-like element which is composed of a fixed wall 9, a movable wall 10, hereinafter termed access flap, and an additional wall portion 11, which is fixed to the wall 9 flush to the access flap 10 and covers the part of the wall 9 that is not covered by the access flap 10. The portion 11, together with the fixed wall 9, delimits a compartment for containing the pusher, described hereinafter, when the magazine is in the loading position.

Figure 5:
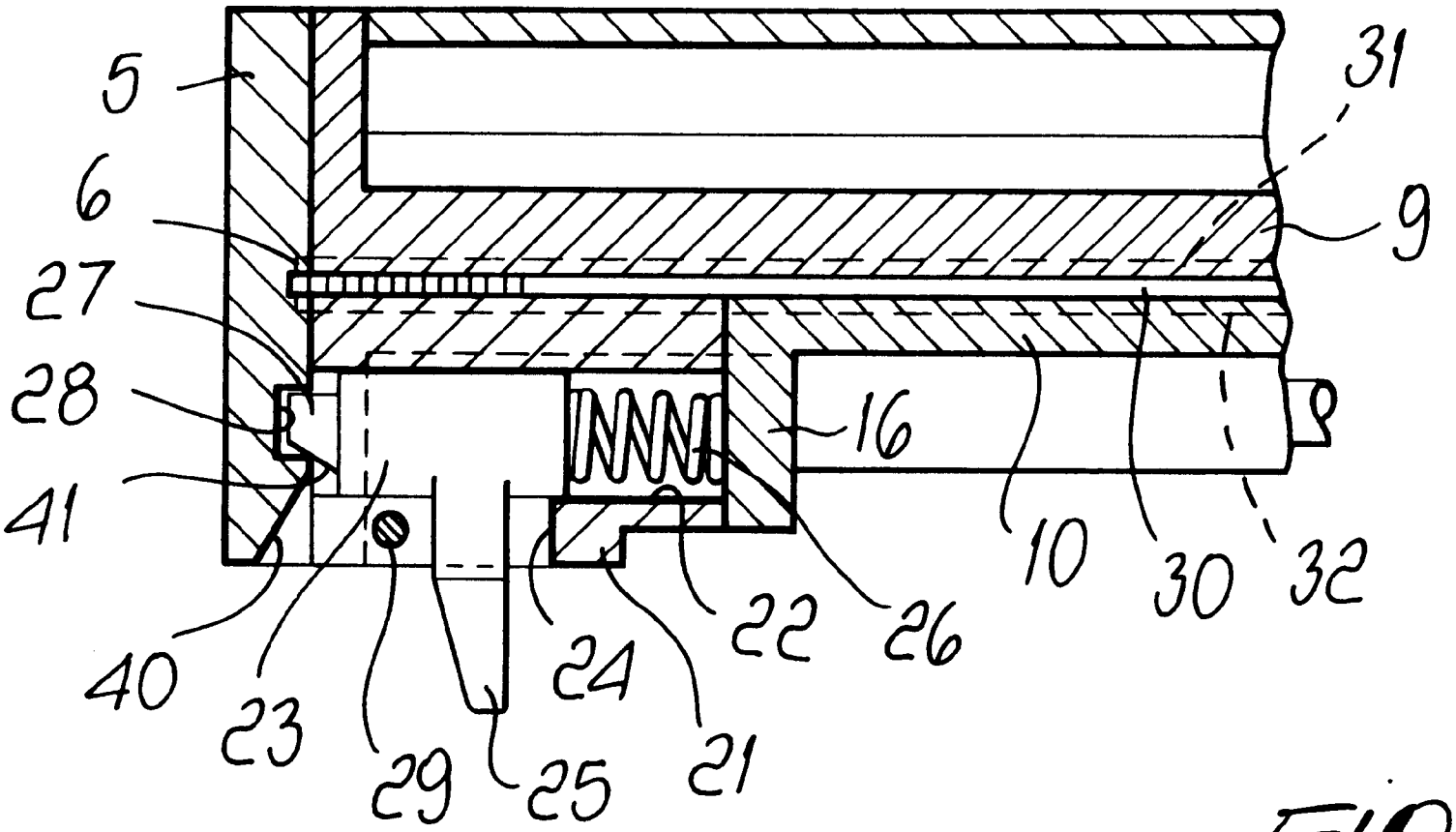
FIG. 5 is a sectional view, taken along the plane V—V of FIG. 4.

The access flap 10 is hinged to the fixed wall 9 at the edge that lies furthest from the handle 3 about the axis A. Hinging is provided by means of coaxial pins 12 and 13 which are rotatably inserted in bushes 14 and 15, rigidly coupled to the portion 11 and to the end of the fixed wall 9 which is proximate to the firing tube 5. The access flap 10 has, at the end that lies adjacent to the firing tube 5, an external protrusion 16 whereto a body 19 is fixed by means of screws 17 and 18; said body 19 has an L-shaped configuration, with a wall which is co-planar to the access flap and a front wall which is perpendicular to the access flap 10 and is adapted to close the firing channel to the rear. A recess 20 is formed in the protrusion 16 and a raised portion 21, rigidly coupled to the body 19, is accommodated in said recess. A hole 22 is formed in the raised portion 21 (see FIG. 5) and a pin 23 is guided therein; a lug 25 protrudes externally from said pin through a slot 24 of the raised portion and acts as a button for actuating the pin 23. The pin 23 is pushed outward, through the front wall of the body 19 at right angles to the access flap 10, by a spring 26 so that when the access flap is in the closure position the pin 23 can engage, by means of a projection 27, in a hole 28 formed in the firing tube 5. A pin 29 which acts as contrast element prevents the pin 23 from escaping, when the access flap is open, from the hole 22 under the thrust of the spring 26.

When the access flap 10 is closed, the channel 30 for guiding the fasteners 7 is formed between the fixed wall 9 and the access flap 10; in the illustrated example, said fasteners are constituted by T-shaped nails. Longitudinal parallel slots 31 and, respectively, 32 are formed both in the wall 9 and in the access flap 10, so that in the closed position of the magazine 8, i.e., when the access flap 10 is adjacent to the wall 9, the slots 31 lie exactly opposite the slots 32; said slots 31 and 32 are meant to accommodate the head of the fasteners 7 according to their length.

The advancement of the fasteners 7 in the channel 30 is determined by the pusher 33, which in the position for loading the nail firing tool is accommodated in a seat formed at the end of the magazine that lies furthest from the tube 5, between the portion 11 and the fixed wall 9. An actuation lever 34 is rigidly coupled to the pusher 33, and a slot 35 is formed in said lever. A retractable pin 36 protrudes from the portion 11 and is loaded by a spring which is not shown in the drawing.

When the nail firing tool is in the operating configuration, the access flap 10 is closed and the pusher 33, with the lever 34 disengaged from the pin 36, is actuated toward the firing tube 5 by a spring 37 which winds around a pulley 38 rotatably supported in the fixed wall 9 proximate to the firing tube 5. The spring 37 lies within a chamber 39 which is formed laterally with respect to the fixed wall 9 by a covering plate 39*a*. One of the ends of the spring is fixed to the pusher 33, while the opposite end is fixed to the fixed wall 9 proximate to the portion 11. Due to the thrust applied by the spring 37, the pusher 33 causes the fasteners 7 to advance along the guiding channel 30 toward the firing tube 5, so that the first one of said fasteners arranges itself in position inside the firing channel 6, ready to be ejected by the hammer blade.

In order to load new fasteners or access the fastener guiding channel 30 and obviate any malfunction, it is sufficient to lock the pusher 33 in the loading position, making the pin 36 enter the hole 35, then move the lug 25 of the access flap 10, so that the projection 27 of the pin 23 disengages from the hole 28, and then turn outward the access flap 10, which is now not retained in any way. In this position, the fastener guiding channel 30 is fully open and it is very simple to remedy any malfunction anywhere within the channel.

Closing the access flap 10 requires no additional operations, since conveniently in the firing tube, at the level of the pin 23, a ramp 40 is provided which, during the closure of the access flap, initially facilitates the retraction of the pin 23 into the hole 22 of the raised portion 21 and the subsequent engagement of the projection 27 in the hole 28 of the firing tube 5. In order to release the pusher 33 from the loading position it is necessary to force the retractable pin 36 to retract until the lever 34 has been disengaged; at this point, the pusher 33, due to the tension of the spring 37, causes the advancement of the fasteners 7 toward the firing channel 6.

Advantageously, the projection 27 of the pivot 23 has a chamfer 41 which, when said projection 27 is inserted in the respective hole of the tube, generates a force component which is adapted to retain the access flap 10 so that it rests against the fixed wall 9, thus reducing the transverse play of the fasteners.

It has thus been observed that the invention achieves the intended aim and object.

The invention thus conceived is susceptible of numerous modifications and variations, all of which are within the scope of the inventive concept. In particular, the access flap 10 can be hinged to the side of the magazine that is adjacent to the handle instead of to the opposite side. All the details may also be replaced with other technically equivalent ones.

In practice, the materials employed, as well as the shapes and the dimensions, may be any according to requirements without thereby abandoning the scope of the protection of the claims that follow.

The disclosures in Italian Utility Model Application No. BO98U000023 from which this application claims priority are incorporated herein by reference.

What is claimed is:

1. A magazine for a compressed-air nail firing tool having a supporting body with a firing tube, the magazine comprising: a fastener guiding channel supported at said tool body for guiding fasteners along an extension thereof; a pair of flat and parallel walls delimiting laterally said guiding channel, with a first one of said walls being fixed to the tool body, and a second one being constituted by an access flap which is hinged to said first fixed wall about a longitudinal axis, whereby to allow opening thereof for lateral access to the fastener guiding channel over at least a part of the guiding channel extension; and retaining means for retaining said access flap in a position for closing said fastener guiding channel.

2. The magazine of claim 1, comprising at mutually opposite surfaces of said guiding channel, a plurality of longitudinal slots, said slots being provided for guidingly accomodating heads of a plurality of T-shaped fasteners.

3. The magazine of claim 1, comprising: a pusher for pushing said fasteners; and at an end portion of said magazine, lying furthest from said firing tube, two fixed walls which form a seat for accommodating said pusher while being in an inactive position.

4. The magazine of claim 1, wherein said retaining means comprise a pin which is inserted in said access flap, and a hole formed in said firing tube, said pin being provided with a projection adapted to engage said hole, and to generate a pressure force between said two walls forming the guiding channel.

5. The magazine of claim 4, comprising a guiding ramp formed at said firing tube for facilitating insertion of said projection in said hole.

* * * * *